United States Patent [19]

Oishi et al.

[11] Patent Number: 4,795,395

[45] Date of Patent: Jan. 3, 1989

[54] ANIMAL MOTION TOY HAVING AN AUTOMATIC ACTION SWITCHING DRIVE MECHANISM

[75] Inventors: Shingo Oishi; Toshihiro Kikuchi, both of Tokyo, Japan

[73] Assignee: Iwaya Corporation, Tokyo, Japan

[21] Appl. No.: 11,885

[22] Filed: Feb. 6, 1987

[30] Foreign Application Priority Data

Jul. 1, 1986 [JP] Japan ..... 61-154662

[51] Int. Cl.[4] ..... A63H 3/28

[52] U.S. Cl. ..... 446/175; 446/303; 446/355

[58] Field of Search ..... 446/175, 303, 316, 353, 446/354, 355, 377

[56] References Cited

U.S. PATENT DOCUMENTS

| | | | |
|---|---|---|---|
| 934,025 | 9/1909 | Steiff | 446/354 |
| 2,921,408 | 1/1960 | Leblic | 446/175 |
| 3,398,480 | 8/1968 | Tsunoda | 446/175 |
| 3,538,639 | 11/1970 | Tomaro | 446/175 |
| 3,659,379 | 5/1972 | Suda | 446/355 |
| 3,722,136 | 3/1973 | Thorn et al. | 446/354 |
| 4,139,968 | 2/1979 | Milner | 446/175 |
| 4,245,515 | 1/1981 | Iwaya | 446/377 |
| 4,389,811 | 6/1983 | Iwaya et al. | 446/353 |
| 4,571,208 | 2/1986 | Saigo et al. | 446/353 |
| 4,673,371 | 6/1987 | Furukawa | 446/175 |

FOREIGN PATENT DOCUMENTS

| | | | |
|---|---|---|---|
| 282305 | 12/1927 | United Kingdom | 446/355 |
| 370803 | 4/1932 | United Kingdom | 446/377 |
| 943154 | 11/1963 | United Kingdom | 446/377 |
| 2047551 | 12/1980 | United Kingdom | 446/355 |

*Primary Examiner*—Robert A. Hafer
*Assistant Examiner*—Charles H. Harris
*Attorney, Agent, or Firm*—James E. Nilles; Donald C. McGaughey

[57] ABSTRACT

An animal motion toy wherein a toy body modeled in the form of an animal has movable arm frames on both sides, movable leg frames on both sides, an openable mouth portion, and a built-in sounding member. The arm frames are rotated by a first crankshaft incorporated in the toy body and the mouth portion is opened and closed and the sounding member makes a sound by a second crankshaft incorporated in the toy body. The leg frames are moved by a third crankshaft incorporated in the toy body. A gear changeover mechanism is connected to a motor which is turned on when a microphone provided in the toy body receives a sound generated by an external signal. The gear changeover mechanism is operative to drive either said first and second crankshafts or said third crankshaft.

3 Claims, 8 Drawing Sheets

ANIMAL MOTION TOY HAVING AN AUTOMATIC ACTION SWITCHING DRIVE MECHANISM

BACKGROUND OF THE INVENTION

1. Field of the Invention

The present invention relates to an animal motion toy in which a toy body modeled in the form of an animal is adapted to perform specific motion.

2. Description of the Prior Art

Hitherto, various structures have been proposed as this type of animal motion toy. Many of these structures are arranged such that, as described in Japanese Patent Laid-Open No. 103689/1984, if a switch provided on a toy body is turned on, a motor is driven immediately, a gear-interlinked mechanism engaging with this motor is moved in an interlinking manner, and such motion members as legs of the toy body, which are interlinked with the gear-interlinked mechanism, perform specific motion.

According to the above-described conventional arrangement, since the toy body immediately performs preset motion in a preset sequence, a player merely experiences the pleasure of looking on the motion of the toy body. In addition, there is a problem in that, since the motion is merely repeated in the preset sequence, the player is liable to become tired of it and, hence, the motion lacks sustained interest.

SUMMARY OF THE INVENTION

Accordingly, an object of the present invention is to provide an interesting animal motion toy which gives a player a strong sense of solidarity with a toy body since the toy body is adapted to perform specific motion in response to an instruction of the player, thereby overcoming the drawbacks of the prior art.

Another object of the present invention is to provide an interesting animal motion toy which is capable of securing sustained interest of a player by providing variations to reacting motion, thereby preventing the player's tendency to lose interest in it and securing sustained interest.

To this end, in accordance with one aspect of the present invention, there is provided an animal motion toy comprising: a toy body modeled in the form of an animal and having movable arm frames on both sides, an openable mouth portion, and a built-in sounding member; a drive mechanism incorporated in the toy body and adapted to drive a first crankshaft for rotating the arm frames and a second crankshaft for opening and closing the mouth portion and causing the sounding member to make a sound; and a control unit provided in the toy body, having a microphone for receiving an external sound signal and adapted to control the drive mechanism according to said external signal applied to the microphone.

In accordance with another aspect of the present invention, there is provided an animal motion toy comprising: a toy body modeled in the form of an animal and having movable arm frames on both sides, leg frames on both sides movable back and forth, an openable mouth portion, and a built-in sounding member; a drive mechanism incorporated in the toy body and having a first crankshaft for rotating the arm frames, a second crankshaft for opening and closing the mouth portion and causing the sounding member to make a sound, and a third crankshaft for moving the leg frames back and forth and adapted to drive the crankshafts in steps; and a control unit provided in the toy body, having a microphone for receiving an external sound signal, and adapted to control the drive mechanism according to said external sound signal applied to the microphone.

According to an animal motion toy of the present invention, if an external sound signal is generated for the toy body by clapping hands or the like, this external sound signal is applied to the microphone, and this sound signal is applied to the control unit to operate the control unit, which, in turn, drives the drive mechanism.

Furthermore, the operation of this drive mechanism rotates the first crankshaft and the second crankshaft. The rotation of the first crankshaft rotates the respective arm frames. In addition, the rotation of the second crankshaft causes the upper jaw frame, for instance, to move upwardly in relation to the lower jaw frame, thereby assuming a posture of opening or closing the mouth portion. At the same time, the sounding member makes a sound simultaneously with the operation of the upper jaw frame.

Thus, the toy body exhibits the aforementioned various motion by the sound of clapping of hands, for instance. However, at that juncture, if hands are clapped once, the toy body performs motion by the generation of an external sound signal constituted by the sound of one clapping of hands, and the motion is suspended by the ceasing of the external sound signal. Accordingly, the toy body intermittently performs the above-described motion in response to the external sound signal of the number of clapping of hands.

In addition, in accordance of another embodiment of an animal motion toy of the present invention, when the drive mechanism is driven by an external sound signal, the operation of the drive mechanism rotates the first crankshaft and the second crankshaft or the third crankshaft. The rotation of the first and second crankshafts causes the toy body to perform various motions as in the case of the animal motion toy of the aforementioned first invention. However, the rotation of the third crankshaft moves the leg frames alternately back and forth, so that the toy body exhibits a walking motion.

Furthermore, either the respective operations of the both arm frames, the upper jaw frame of the mouth portion, and the sounding member or the operation of the leg frames is selected and set in advance, the toy body exhibits the selected motion, and when it is preset in such a manner that each of the operations is to be carried out in steps, these operations are automatically changed over to exhibit these operations in steps.

Thus, the toy body exhibits the aforementioned various motions by the sound of clapping of hands, for instance. However, at that juncture, if hands are clapped once, the toy body performs motion by the generation of an external sound signal constituted by the sound of one clapping of hands, and the motion is suspended by the ceasing of the external sound signal. Accordingly, the toy body intermittently performs the above-described motion in response to the external sound signal of the number of clapping of hands.

Other objects, features and advantages of the present invention will become apparent in the following detailed description of the embodiments when read in conjunction with the accompanying drawings.

DESCRIPTION OF THE PREFERRED EMBODIMENTS

Figure 1:
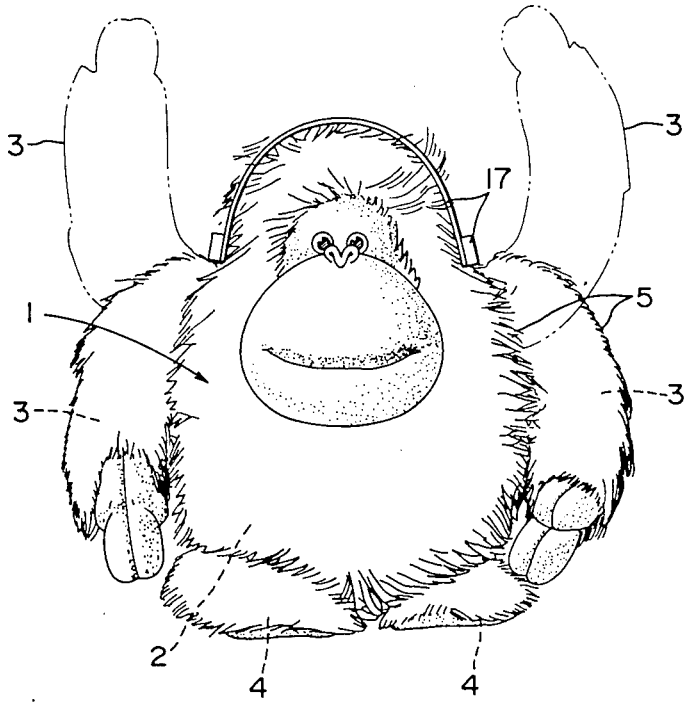
FIG. 1 is a front elevational view of an animal motion toy in accordance with an embodiment of the present invention.
Figure 2:
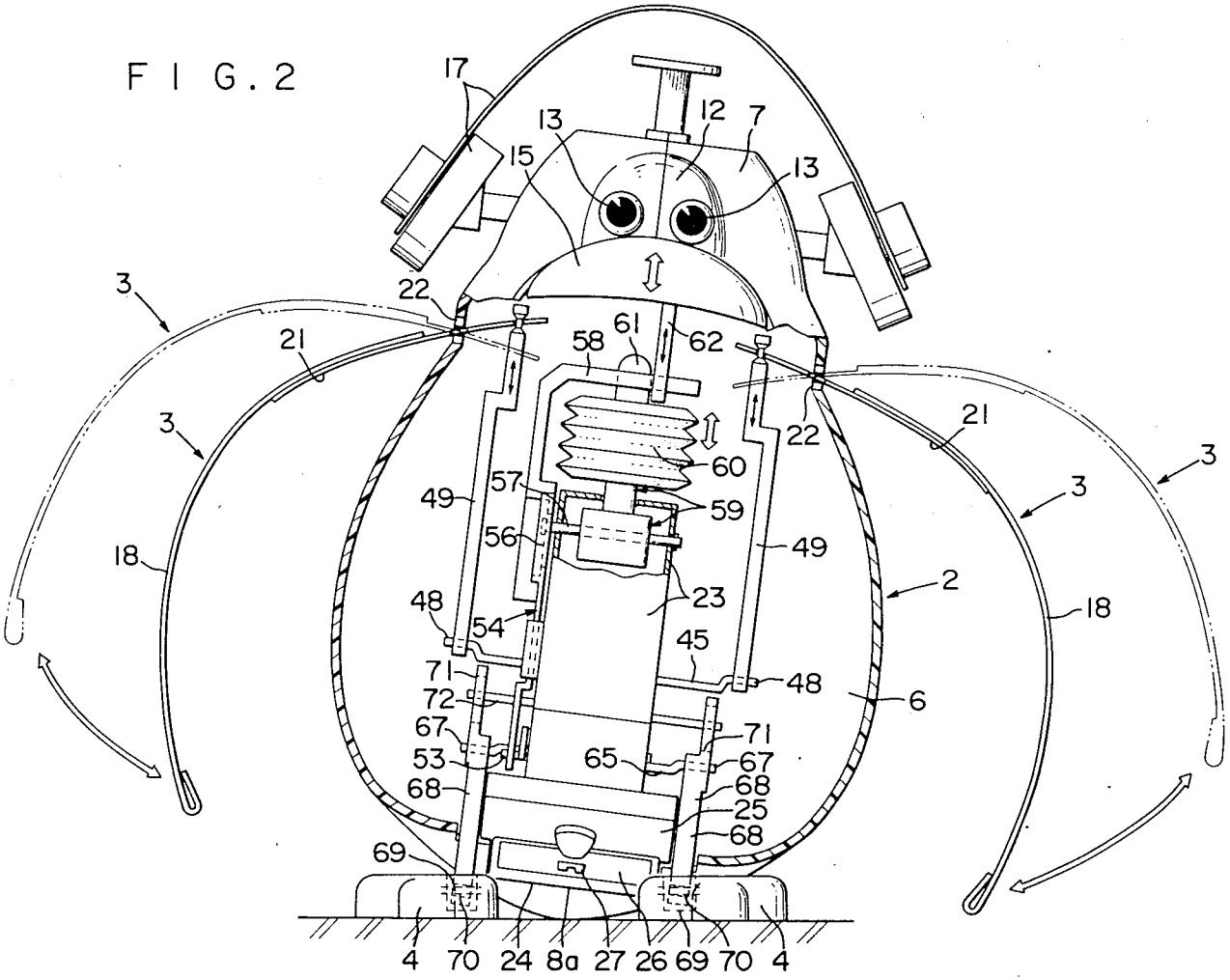
FIG. 2 is a partially-cutaway front elevational view of an internal structure thereof.
Figure 3:
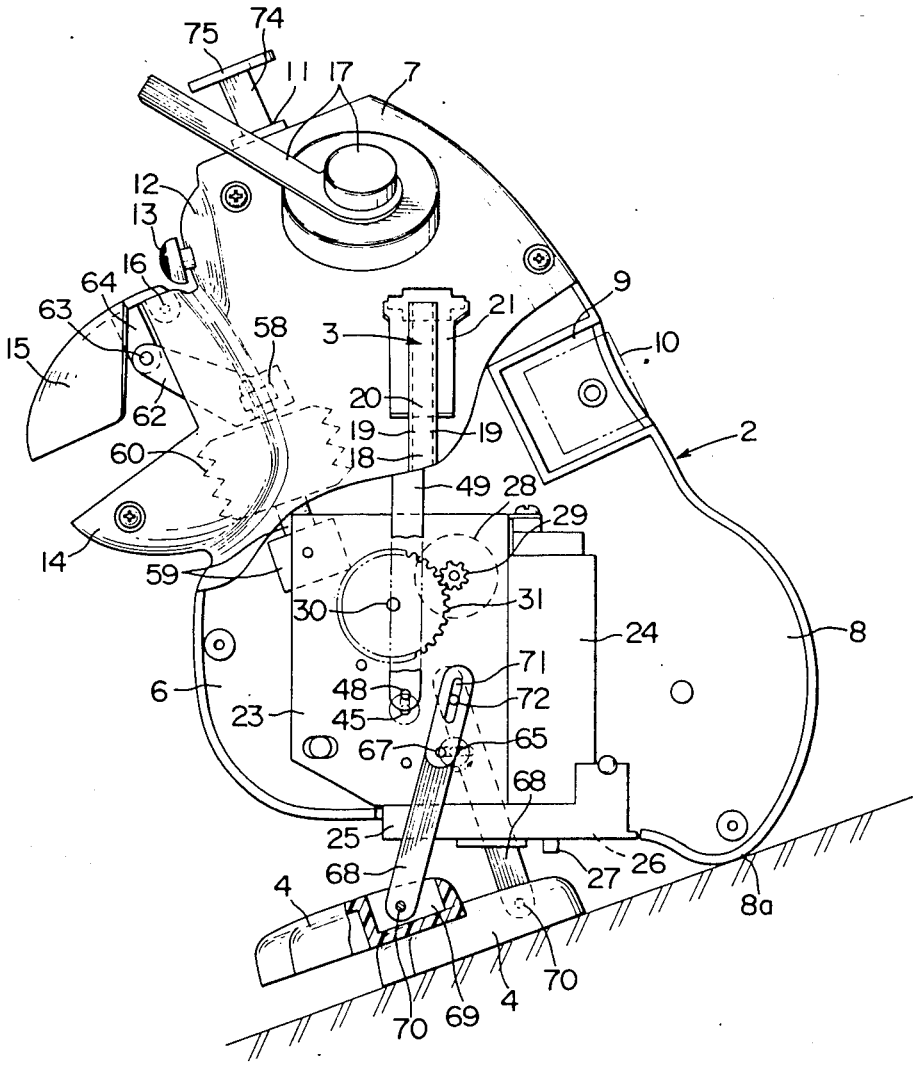
FIG. 3 is a side elevational view taken in the direction of one side thereof.
Figure 4:
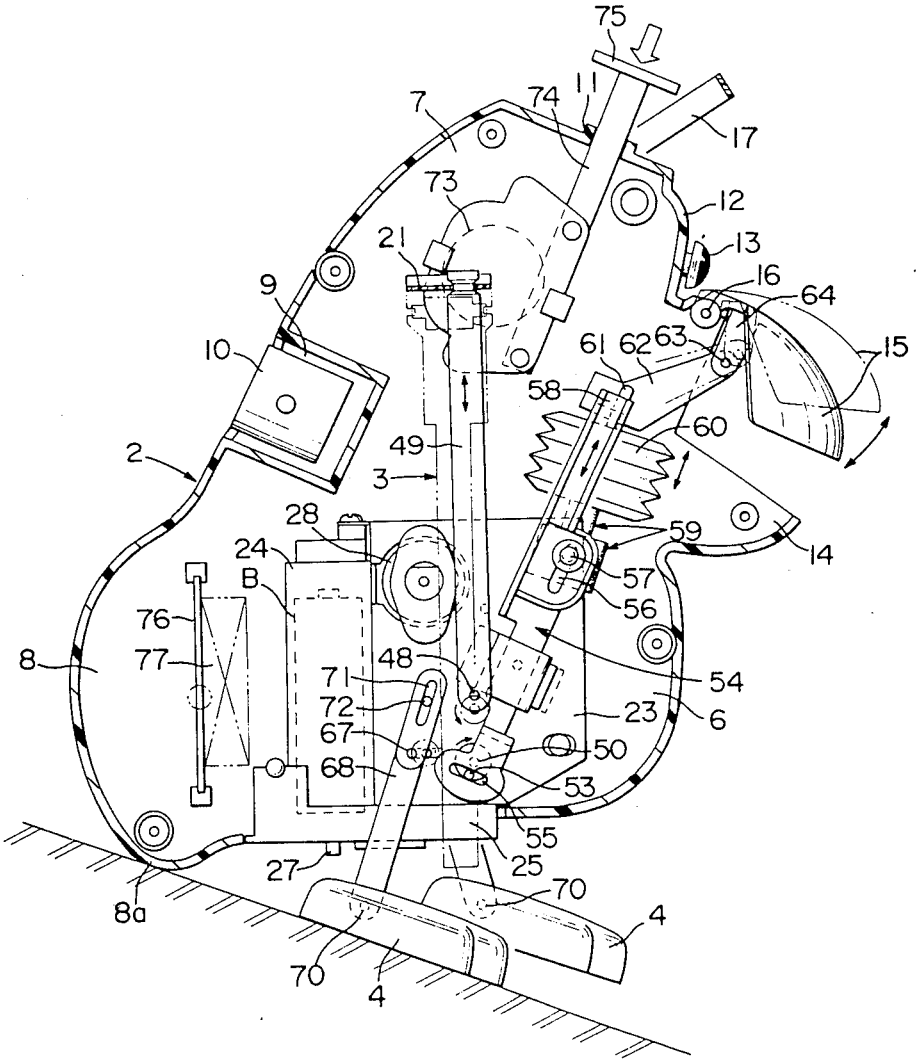
FIG. 4 is a side elevational view taken in the direction of the other side thereof.

In FIGS. 1 to 6, a toy body 1 modeled in the form of, for instance, a monkey comprises a main body frame 2 having upper and lower portions, arm frames 3, 3 on both sides of the upper portion thereof, leg frames 4, 4 on both sides of the lower portion thereof, and a fur coat 5.

The main body frame 2 is formed of synthetic resin and includes a body frame portion 6, a head frame portion 7, and a hip frame portion 8 having in a lower portion thereof a floor-contacting projection 8*a*. An accommodating recess 9 is formed in the rear of the body frame portion 6, and a microphone 10 is installed in this accommodating recess 9. In addition, a guide port 11 is formed in an upper portion of the head frame portion 7. A face frame portion 12 in the front portion is provided with eyes 13, 13. An upper jaw frame 15 which opens and closes a mouth portion relative to a lower jaw frame 14 formed integrally with the face frame portion 12 is fixed openably to the face frame portion 12. A headphone 17 is mounted on the head frame portion 7.

Each of the arm frames 3, 3 on both sides has a flexible frame piece 20 in which a core material 19 is embedded in an elongated planar synthetic resin piece 18. A mounting piece 21 made of synthetic resin is secured integrally with one end of the flexible frame piece 20. A portion of this mounting piece 21 which is adjacent to the other end thereof is inserted and retained in a transversely elongated groove 22 formed on the respective sides of the jaw portion of the main body frame 2 such as to be vertically movable.

A frame member 23 is secured inside the body frame portion 6 of the main body frame 2. A battery case 24 accommodating a power source such as a battery B is secured in the rear portion of this frame member 23. A cover plate 26 is disposed on the underside of the body frame portion 6 in such a manner that a bottom plate 25 of the frame member 23 and the battery case 24 is openable. A main switch 27 projects from the cover plate 26.

The frame member 23 is provided with a drive mechanism A. This drive mechanism A includes a forward and reverse changeover motor 28 electrically connected to the battery B, which is secured to the frame member 23. The motor 28 has a pinion gear 29 constituting a rotary power output. The drive mechanism A also includes a gear changeover mechanism 30-44, best shown in FIGS. 3, 5 and 6, which will now be described. A rotary shaft 30 pivotally mounted on the frame member 23 has a reduction gear 31 nonrotatably mounted thereon that meshes with the pinion 29 of the motor 28. A drive gear 32 is nonrotatably secured to the rotary shaft 30. A rotary shaft 33 is pivotally supported by the frame member 23 such as to be rotatable. A clutch gear 34 meshing with the drive gear 32 is secured to the rotary shaft 33. Claw clutches 35, 36 which engage or disengage upon rotation in the mutually opposite direction are formed at the both side portions of the clutch gear 34. In addition, a first drive gear 39 and a second drive gear 40 are rotatably supported on guide shafts 37, 38 which are rotatable about the rotary shaft 33 extending integrally from the both sides of the clutch gear 34, so that the first and second drive gears 39, 40 are rotatable and axially slidable. A claw clutch 41 disengageably engageable with one claw clutch 35 is formed inside the first drive gear 39, while another claw clutch 42 disengageably engageable with the other claw clutch 36 is formed inside the second drive gear 40. Coil springs 43, 44 are respectively wound around the guide shafts 37, 38 and between the frame member 23 and the respective outer walls of the first and second drive gears 39, 40. The first and second drive gears 39, 40 are respectively urged by the coil springs 43, 44 in the direction of the clutch gear 34, and the engagement between the claw clutches 35, 41 and between the claw clutches 36, 42 is effected, respectively.

The drive mechanism A also includes a first crankshaft 45 rotatably supported by the frame member 23. A first interlinking gear 46, meshing with the first drive gear 39, is fixedly secured to the first crankshaft 45, while a second interlinking gear 47, meshing with the second drive gear 40 is rotatably supported by first crankshaft 45 the same a bearing means 98 on. In addition, the lower ends of lifting and lowering levers 49, 49 are respectively fixed to the crankarms 48, 48 of the end portions of the first crankshaft 45 such as to be rotatable. The upper end portions of the lifting and lowering levers 49, 49 are respectively inserted and retained in the inner end portions, i.e., the other ends, of the mounting pieces 21, 21 of the arm frames 3, 3. The rotation of the first crankshaft 45 causes the lifting and lowering levers 49, 49 on both sides to perform the lifting and lowering motion. At the same time, the arm frames 3, 3 are adapted to be moved vertically about the transversely elongated grooves 22, 22 in the main body frame 2.

In addition, the drive mechanism A further includes a second crankshaft 50 which is pivotally supported by the frame member 23 so as to be rotatable. A first relay gear 51, meshing with the first interlinking gear 46, is fixedly secured to the second crankshaft 50, while a second relay gear 52, meshing with the second interlinking gear 47, is pivotally supported by a bearing means 99 on the same second crankshaft 50 so as to be rotatable. A crank arm 53 which is an end portion of the second crankshaft 50 is inserted rotatably in a transversely elongated insertion hole 55 formed in a lower end portion of the interlinking lever 54. This interlinking lever 54 is disposed vertically movably via a support shaft 57 inserted in a vertically elongated guide hole 56 formed in the midportion of the interlinking lever 5. A pushing piece 58 is formed in a horizontally bent shape at the upper end portion of this interlinking lever 54. A projecting piece 61 of a bellows 60 of a sounding member 59 is retained in the midway of this pushing piece 58. The sounding member 59 is secured to an upper portion of the frame member 23. A lower end portion of an interlinking piece 62 is secured to an end portion of the pushing piece 58 of the interlinking lever 54. A lower end portion of an operating piece 64 projecting downwardly from the proximal end of the upper jaw frame 15 via a shaft lever 63 is pivotally secured to an upper end portion of the interlinking piece 62. The interlinking lever 54 is moved vertically by the crankarm 53. The sounding member 59 is pushed by the pushing piece 58 thereof to cause the sounding member 59 to make a sound. The vertical movement of the interlinking piece 62 opens and closes the upper jaw frame 15 with a horizontal shaft 16 as a fulcrum.

The drive mechanism A further includes a third crankshaft 65 which is pivotally supported by the frame member 23 such as to be rotatable. A leg-driving gear 66 meshing with the second relay gear 52 is fixedly secured to the third crankshaft 65. Substantially intermediate portions of leg levers 68, 68 are each pivotally supported by crankarms 67, 67, i.e., the end portions thereof, such as to be rotatable. The leg frames 4, 4 are each pivotally secured to the lower end portions of the leg levers 68, 68 on both sides via transversely elongated insertion holes 69, 69 and support shafts 70, 70. The both end portions of a guide support lever 72 pivotally supported by the frame member 23 are rotatably inserted in vertically elongaged guide holes 71, 71 formed at upper end portions of the leg levers 68, 68 on both sides.

Figure 7:
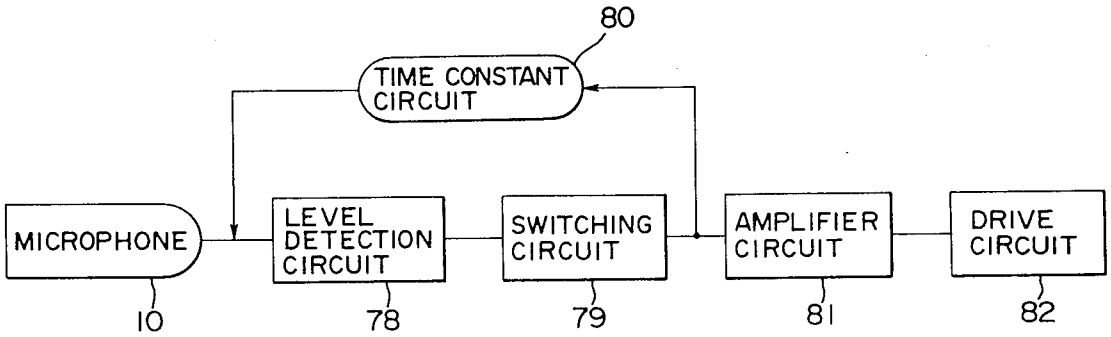
FIG. 7 is a block diagram of a control unit.
Figure 6:
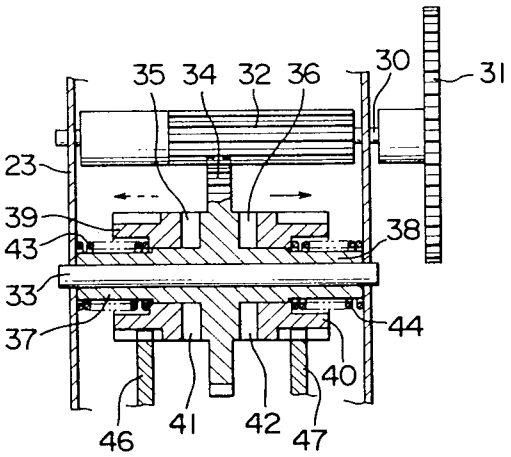
FIG. 6 is a cross-sectional view of a clutch mechanism thereof.

A rotary switch 73 connected to the motor 28 and used to change over the forward and reverse rotation of the motor 28 is secured inside the head frame portion 7 of the main body frame 2. An operating lever 74 for changing over this rotary switch 73 projects vertically movably from the inside of the guide port 11 formed in the head frame 7, and a pressing portion 75 is formed at an upper end portion of the operating lever 74. A circuit board 76 is secured inside the hip frame portion 8 of the main body frame 2. A control unit 77 connected to the microphone 10, the motor 28, and the rotary switch 73 and adapted to control the motion of the toy body 1 is disposed on the circuit board 76. As shown in FIG. 7, this control unit 77 comprises the microphone 10, a level detection circuit 78 for detecting the level of a sound signal applied to the microphone 10, a switching circuit 79 operative by a certain detection level of the level detection circuit 78, a time constant circuit 80 for holding the operation of the switching circuit 79 for a fixed time, an amplifier circuit 81, and a drive circuit 82 for driving the motor 28. The circuits 78, 79, 80, 81, 82 constitute means responsive to a sound signal for connecting the power source B to turn on motor 28 and operate the gear changeover mechanism for a preselected period of time and for disconnecting the power source B to turn off motor 28.

The operation of the above-described arrangement will be described hereafter.

First, the main switch 27 is turned on. Then, if an external sound signal such as specific acoustic sound or vibratory sound is generated by clapping of hands, a musical instrument such as a whistle, or an acoustic instrument, this external sound signal is applied to the microphone 10, and the output thereof is transmitted to the level detection circuit 78 as a sound signal. Then, this level detection circuit 78 detects the level of the input sound signal, and when the sound signal is at a predetermined level, the sound signal is applied to the switching circuit 79, thereby turning on the switching circuit 79. The turning on of this switching circuit 79 operates the time constant circuit 80 and holds the on-state of the switching circuit 79 for a fixed time, and, at the same time, amplifies the same by the amplifying circuit 81, and outputs to the drive circuit 82. The operation of the drive circuit 82 drives the motor 28 in the forward direction, for instance, and the driving of the motor 28 is stopped after a lapse of a fixed time.

Figure 5:
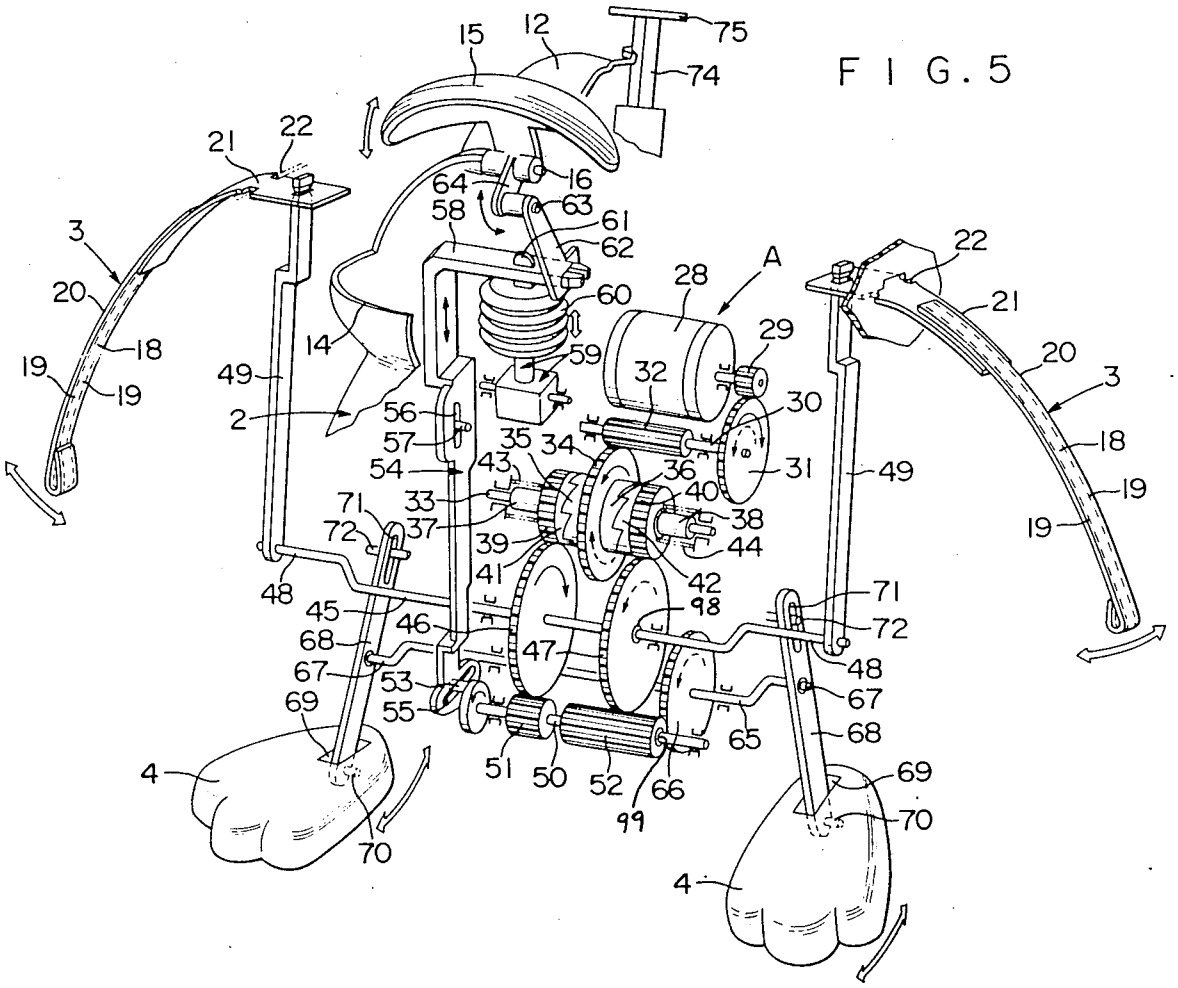
FIG. 5 is an exploded perspective view of an internal structure thereof.

When the motor 28 is driven, the drive gear 32 is rotated via a pinion 29 and the reduction gear 31, and the clutch gear 34 meshing with the drive gear 32 is rotated in the direction of the arrow of a solid line on gear 34 in FIG. 5. When the clutch gear 34 is rotated, the first drive gear 39 is moved in an interlinking relationship via the claw clutches 35, 41 which are engaged with each other, and is rotated in the direction of the arrow of a solid line in FIG. 5. The clutch 36 of the clutch gear 34 rotates while sliding without engaging with the claw clutch 42 of the second drive gear 40 by reason of the claws of clutch 36 pushing the second drive gear 40 outwardly in the axial direction in opposition to the coil spring 44. Accordingly, when the motor 28 is rotated forwardly, the first drive gear 39 is rotated by means of the clutch gear 34 without imparting the rotation to the second drive gear 40.

Then, the rotation of the first drive gear 39 rotates the first crankshaft 45 via the first interlinking gear 46. At the same time, the rotation of the crankarms 48, 48 of both ends thereof that are offset with each other causes the respective lifting and lowering levers 49, 49 substantially simultaneously, with the result that the arm frames 3, 3 are vertically moved substantially simultaneously, with the transversely elongated groove 22 as the center. In this case, since the arm frames 3, 3 on both sides are formed flexibly, when they are set in a state in which they are suspended on both sides of the main body frame 2, as shown in FIG. 1, the arm frames 3, 3 are moved vertically in this suspended state. Meanwhile, when they are set in a state in which they are lifted to the upper portions of both sides of the head frame portion 7, the arm frames 3, 3 are moved vertically in this lifted state. Incidentally, when a setting is made so that one arm frame 3 is suspended and the other arm frame 3 is lifted, the arm frames 3, 3 are moved vertically in that state of setting.

In addition, the rotation of the first interlinking gear 46 causes the second crankshaft 50 to rotate, and the rotation of the crankarm 53, i.e., one end portion thereof, causes the interlinking lever 54 to move vertically. The pushing piece 58 of this interlinking lever 54 causes the bellows 60 of the sounding member 59 to be extended and shrunk, thereby causing the sounding member 59 to make a sound. On the other hand, the vertical movement of the interlinking piece 62 fixed to the pushing piece 58 causes the operating piece 64 to move vertically, and, at the same time, causes the upper jaw frame 15 to move vertically in relation to the lower jaw frame 14 with the horizontal shaft 16 as the center, thereby causing the mouth portion to perform an opening and closing operation.

Accordingly, the toy body 1 exhibits motion of singing and dancing while opening and closing the mouth by vertically moving the upper jaw frame 15 with the both arm frames 3, 3 rotating vertically. Each of these motions is effected in response to the generation of the external sound signal of a specific clap when hands are clapped once. When hands are clapped intermittently several times, each of the aforementioned motions is repeated intermittently in response to the external sound signal generated by that number of claps. Accordingly, the motor 28 is automatically driven in response to the clap and the toy body 1 performs the aforementioned motion, and when the clap ceases, the motor 28 automatically stops, and the toy body 1 stops the motion. Then, the motor 28 is set for standby ready for the next external sound signal.

If the fur coat 5 on the upper portion of the head frame 7 of the toy body 1 is pushed, the pushing portion 75 of the operating lever 74 of the rotary switch 73 is pushed, which in turn causes the operating lever 74 to be lowered, and, at the same time, the rotary switch 73 is changed over, thereby changing over the motor 28 from the forward rotation to the reverse rotation.

In this state, when an external sound signal, such as the one described above, is applied into the microphone 10, the motor 28 rotates in the reverse direction by means of the aforementioned operations of the control unit 77. The drive of this motor 28 rotates the clutch gear 34 in the direction of the dotted line arrow on gear 34 in FIG. 5. The second drive gear 40 is moved in an interlinking relationship via the mutually engaging claw clutches 36, 42 and rotates in the direction of the dotted line arrow on gear 34 in FIG. 5. The claw clutch 35 of this clutch gear 34 rotates while pushing the first drive gear 39 outwardly in the axial direction in opposition to the coil spring 43 while sliding past but without engaging with the claw clutch 41 of the first drive gear 39. Accordingly, when the motor 28 is rotated in the reverse direction, the second drive gear 40 is rotated by means of the clutch gear 43 without imparting the rotation to the first drive gear 39.

As a result, the various types of motion of the toy body 1, such as dancing while singing, at the time when the motor 28 is rotated in the forward direction are stopped.

In addition, as described earlier, the rotation of the second drive gear 40 shifts the leg driving gear 66 via the second interlinking gear 47 and the second relay gear 52, which in turn rotates the third crankshaft 65 of the leg driving gear 66. The rotation of the transversely offset crankarms 67, 67, i.e., end portions of the third crankshaft 65, causes the leg levers 68, 68 to be alternately moved back and forth with the end portions of the guide support lever 72 inserted in the guide holes 71, 71 as the fulcrum, thereby moving the leg frames 4, 4 alternately back and forth.

Accordingly, the toy body 1 exhibits walking motion while swinging to the right and the left by means of the operation of the leg frames 4, 4 that are moved back and forth with the floor-contacting projecting portion 8*a* located at the lower portion of the hip frame portion 8 as the center. This walking motion is effected such as to respond to an external sound signal, as mentioned above.

Thus, by changing over the rotary switch 73 with the main switch 27 turned on, the motor 28 is changed over to the forward or reverse direction. Therefore, the motor 28 is driven by an external sound signal, and the toy body 1 alternately repeats, in response to external sound signal and for respective fixed times, the motion of singing and dancing while opening and closing the mouth by vertically moving the upper jaw frame 15 while vertically rotating the arm frames 3, 3 as well as the motion of walking.

Figure 10:
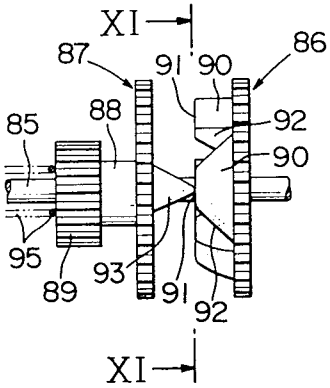
FIG. 10 is a front elevational view of a changeover mechanism thereof.
Figure 11:
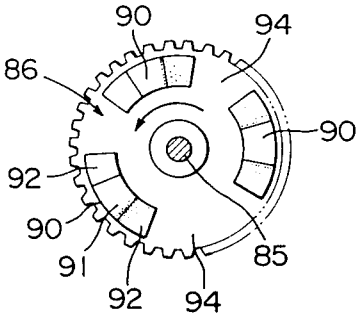
FIG. 11 is a cross-sectional view taken along a line XI—XI of FIG. 10.
Figure 8:
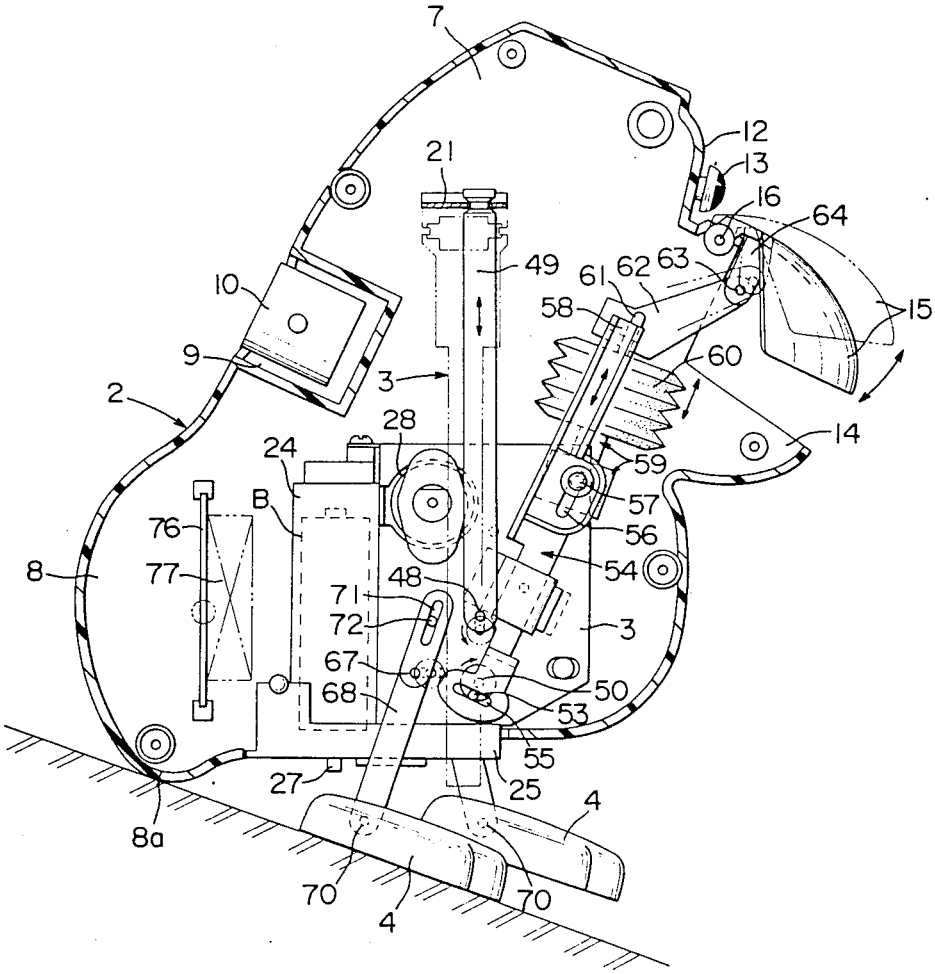
FIG. 8 is a side elevational view illustrating an internal mechanism of an animal motion toy in accordance with another embodiment of the present invention.
Figure 9:
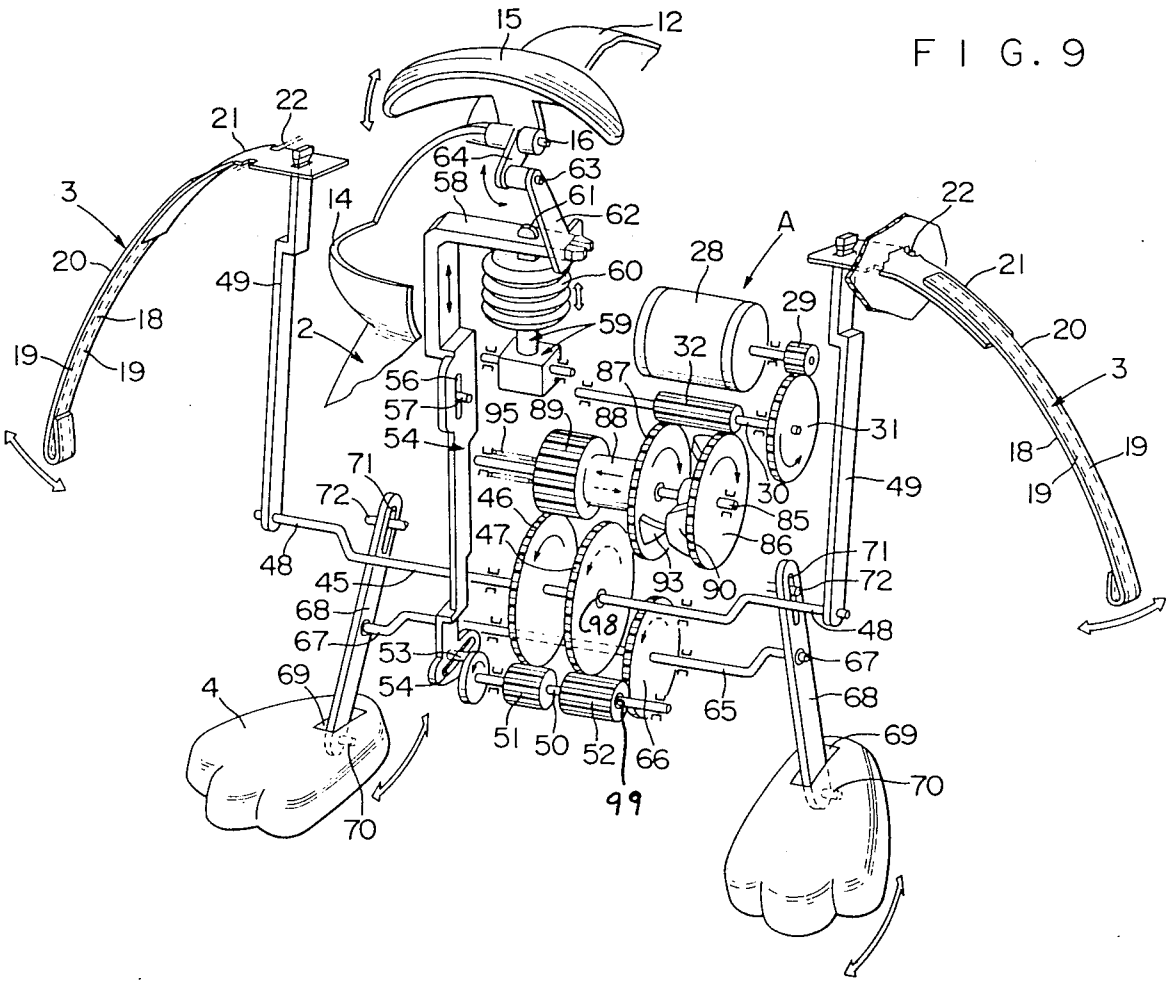
FIG. 9 is an exploded perspective view thereof.

In the foregoing embodiment, description has been made of a case where the motion of the arm frames 3, 3, the upper jaw frame 15, and the sounding member 59 and the motion of the leg frames 4, 4 are manually changed over by providing the manually operated rotary switch 73. However, an arrangement may be made such as to automatically change over these motions by providing an automatic gear changeover mechanism 30, 31, 85–95 (FIGS. 9, 10 and 11).

In this case, for instance, an arrangement shown FIGS. 8 to 11 may be adopted. This automatic changeover mechanism is arranged as follows: A rotary shaft 85 is rotatably supported by the frame member 23. A changeover operation gear 86 meshing with the aforementioned drive gear 32 is nonrotatably secured to this rotary shaft 85. A sliding gear 87 meshing with the drive gear 32 is pivotally supported by the rotary shaft 85 such as to be axially slidable. A changeover gear 89 formed in a fixed positional relationship with the sliding gear 87 via a spacer 88 is pivotally supported by the rotary shaft 85 such as to be slidable. A plurality of pushing projections 90 having different pitches relative to each other are formed integrally on the peripheral side portion of the changeover operation gear 86 on the side of the sliding gear 87. These pushing projections 90 are each formed substantially in the shape of a herringbone by means of a pushing apex surface 91 and guide slanting surfaces 92 provided on both sides of the pushing apex surface 91. In addition, a substantially triangular engaging projection 93 is formed integrally with the outer side portion of the sliding gear 87 on the side of the changeover operation gear 86. The tip of this engaging projection 93 is adapted to engage consecutively with the pushing apex portions 91, the guide slanting surfaces 92, and sliding surfaces 94 between the pushing projections 90 of the respective pushing projections 90 of the changeover operation gear 86. When the engaging projection 93 is engaged with the pushing apex portion 91 of each of the pushing projections 90, the changeover gear 89 meshes with the first interlinking gear 46. When the engaging projection 93 is engaged with the sliding surface 94, the changeover gear 89 meshes with the second interlinking gear 47. Furthermore, a coil spring 95 is wound around the rotary shaft 85 between the outer peripheral portion of the changeover gear 89 and the frame member 23, and the sliding gear 87 is constantly urged to approach the changeover operation gear 86 by means of this coil spring 95 via the changeover gear 89 and the spacer 88. The changeover operation gear 86 and the sliding gear 87 both meshing with the drive gear 32 are formed with a mutually different number of teeth.

By providing such an arrangement, when the motor 28 is driven by receiving an external sound signal, as in the case of the preceding embodiment, the drive gear 32 is rotated, and the changeover operation gear 86 and the sliding gear 87 are rotated simultaneously. As the changeover operation gear 86 and the sliding gear 87 rotate, the sliding gear 87 is gradually separated from the changeover operation gear 86 in opposition to the coil spring 95 owing to the mutual difference in the number of teeth. The tip portion of the engaging projection 93 runs up on the pushing apex portion 91 of the pushing projection 90 and is pushed by the same. At the same time, the changeover gear 89 meshes with the first interlinking gear 46 and is rotated by the same. The first crankshaft 45 of this first interlinking gear 46 and the second crankshaft 50 of the first relay gear 51 are rotated, and the arm frames 3, 3 the sounding member 59, and the upper jaw frame 15 exhibit their respective motions, as described in the preceding embodiment.

In addition, the rotation of the drive gear 32 continues to rotate the changeover operation gear 86 and the sliding gear 87. At the same time, the tip portion of the engaging projection 93 of the sliding gear 87 is rotated while sliding on the pushing apex portion 91 of the pushing projection 90 of the changeover operation gear 86 owing to the mutual difference in the number of teeth. Then, the tip portion of the engaging projection 93 is disengaged from the pushing apex portion 91 of the pushing projection 90. At the same time, the sliding gear 87 is pushed in the axial direction by means of the returning force of the coil spring 95. Simultaneously as the tip portion of the engaging projection 93 moves from one guide slanting surface 92 and engages with the sliding surface 94, the changeover gear 89 which is integral with the sliding gear 87 is disengaged from the first interlinking gear 46 and meshes with the second interlinking gear 47.

The rotation of this second interlinking gear 47 rotates the third crankshaft 65 via the second relay gear 52 and the leg driving gear 66, and the leg frames 4, 4 are moved alternately back and forth, as in the case of the preceding embodiment.

Thus, the rotation of the drive gear 32 in one direction rotates the changeover operation gear 86 and the sliding gear 87. As they rotate continuously, the engagement of the changeover gear 89 is automatically changed over alternately relative to the first interlinking gear 46 and the second interlinking gear 47 by means of the approaching and separating movements of the sliding gear 87 with respect to the changeover operation gear 86. The interlinked engagement of these changeover operations allows the toy body 1 to exhibit the same motion as that of the preceding embodiment.

In both embodiments, the gear changeover mechanism and the automatic gear changeover mechanism are operatively connected, as shown in FIGS. 5 and 9, between the motor output shaft 29 and the first, second and third crankshafts, 45, 50 and 65, to either rotate one of the first, second or third crankshafts, i.e. 65, but not the other two of the crankshafts, i.e. 45, 50 or to rotate the other two crankshafts, i.e. 45, 50, but not the one crankshaft, i.e. 65.

In accordance with one aspect of the present invention, when the toy body receives an external sound signal, the arm frames on both sides, the mouth portion, and the sounding member are operated, so that the toy body makes a sound while operating its both arms and opening and closing the mouth. Accordingly, the toy body positively displays the aforementioned motion as if it responds to an instruction of a player who generates an external sound signal. Moreover, the toy body reacts in response to the frequency of the external sound signal generated. Therefore, it becomes possible for the player to instantly or intermittently control the motion of the toy body as he desires. Accordingly, the player's sense of solidarity with the toy body is strong, and it therefore becomes possible to provide a very interesting animal motion toy as compared with an animal toy whose motion the player just looks on.

In accordance with another aspect of the present invention, since the toy body moves the leg frames on both sides thereof back and forth, the leg frames can be operated independently or in an interlinking relationship by means of an automatic changeover with respect to the motion of the arm frames, the upper jaw frame, and the sounding member, with the result that the types of motion responding to external sound signal increase, and the animal toy displays an unexpected initial movement depending on a point of action at which the motion is stopped. Accordingly, it becomes possible to provide an interesting animal motion toy body which is capable of securing sustained interest by preventing the tendency to readily lose interest in the motion by virtue of its unexpected movements.

What is claimed is:

1. An animal motion toy comprising:

a toy body (1) modeled in the form of an animal having upper and lower portions, with each of said portions presenting left and right sides;

movable arm frame (3) mounted on said toy body at said right and left sides of said upper portions for up and down movement;

a leg frame (4), each having a leg lever 68, mounted on said toy body at said right and left sides of said lower portion for back and forth movement;

a mouth portion (15) mounted on said toy body for movement between open and closed positions;

a sounding member (60) mounted on said toy body having means to generate a sound when actuated;

a power source (B);

a drive mechanism (A) mounted on said toy body including, first crankshaft (45) rotatably mounted on said toy body and having a crank arms (48) at both ends thereof, lifting and lowering levers (49) each having an upper end and a lower end, each of said lower ends connected to one of said crank arms (48) of said first crankshaft, each of said upper ends connected to said arm frames (3) for moving said arm frame up and down at said left and right sides substantially at the same time in response to rotation of said first crankshaft;

a second crankshaft (50) rotatably mounted on said toy body and having a crank arm (53) at one end thereof, an interlinking lever (54) having a bottom end and a top end, said bottom end connected to said second crankshaft crank arm (53) and said top end connected to said mouth portion (15) for moving said mouth portion between said mouth open and closed position in response to rotation of said second crankshaft;

a third crankshaft (65) rotatably mounted on said toy body and having crank arms (67) at each end thereof, each of said third crankshaft crank arms connected to one of said leg levers of said leg frames for moving said leg frames back and forth in response to rotation of said third crankshaft (65);

a motor (28) having a rotating power output shaft (29), a single gear changeover mechanism (30–44 or 31, 32, 85–95) mounted on said toy body and operatively connected between said motor output shaft and said first, second and third crankshafts, said single gear changeover mechanism being operable in response to rotation of said motor output shaft to effect rotation of one of said first, second or third crankshafts but not the other two of said crankshafts, and subsequent rotation of said other two of said crankshafts but not said one crankshaft; and a control unit (77) mounted on said toy body, said control unit including a microphone (10) for receiving an external sound signal, and means (78-82) responsive to said sound signal to connect said power source to turn on said motor and operate said gear changeover mechanism for a preselected period of time and then disconnect said power source to turn off said motor and inactivate said gear changeover mechanism.

2. An animal motion toy according to claim 1 wherein said power output shaft of said motor is reversibly rotatable and wherein said single gear changeover mechanism comprises an alternatively actuatable clutch means (35, 36) responsive to the direction of rotation of said power output shaft to effect an order of rotation of said first, second and third crankshafts.

3. An animal motion toy according to claim 1 wherein said power output shaft is rotatable in only one direction and wherein said single gear changeover mechanism comprising a changeover gear means (86, 87) responsive to rotation of said output shaft in said one direction to effect an order of rotation of said first, second and third crankshaft.

* * * * *